United States Patent [19]

Wartinger et al.

[11] 4,313,673

[45] Feb. 2, 1982

[54] DUPLEX OPERATION IN A REPRODUCTION MACHINE

[75] Inventors: Raymond C. Wartinger, Webster; Charles D. Braswell, Rochester; Neal S. Buchalter; John W. Daughton, both of Fairport; Robert G. Ellis, Penfield, all of N.Y.

[73] Assignee: Xerox Corporation, Stamford, Conn.

[21] Appl. No.: 89,331

[22] Filed: Oct. 30, 1979

[51] Int. Cl.[3] ..... G03G 15/00

[52] U.S. Cl. ..... 355/14 R; 235/92 SB; 355/3 SH; 355/14 SH; 355/23; 355/77

[58] Field of Search ..... 355/14 R, 14 CU, 14 SH, 355/3 SH, 24, 23, 26, 77; 235/92 SB; 271/3.1, 4

[56] References Cited

U.S. PATENT DOCUMENTS

| | | | |
|---|---|---|---|
| 3,700,231 | 10/1972 | Aasen et al. | 271/65 X |
| 4,211,483 | 7/1980 | Hannigan et al. | 355/14 R |
| 4,229,100 | 10/1980 | Travis | 235/92 SB |

FOREIGN PATENT DOCUMENTS

| | | | |
|---|---|---|---|
| 54-2721 | 1/1979 | Japan | 271/127 |
| 54-2722 | 1/1979 | Japan | 271/127 |

OTHER PUBLICATIONS

*Research Disclosure*, May 1975, #13329 "Document Feeder," p. 21.

*Primary Examiner*—Richard L. Moses
*Attorney, Agent, or Firm*—Ronald F. Chapuran

[57] ABSTRACT

Simplex to duplex copying, is simplified in particular, the requirements are to reverse order the documents for a first pass, place all the documents in a recirculating document handler, move half copies or one sided copies to an auxiliary feed tray, and finally reverse the order of the originals. In another feature, the blank sheets are automatically scheduled and not billed on a customer billing meter.

5 Claims, 10 Drawing Figures

DUPLEX OPERATION IN A REPRODUCTION MACHINE

This invention relates to electrophotographic copiers, and more particularly, to an electrophotographic copier for making two sided copies.

CROSS RELATED REFERENCES

For further information relating to this application, reference is made to the following companion U.S. patent applications filed concurrently herewith to the common assignee U.S. Ser. No. 089,334, Sheet Registration in a Finishing Station; U.S. Ser. No. 089,335, now allowed Sheet Reversing Apparatus for a Copier/Finisher System; U.S. Ser. No. 089,336, Reproduction Machine with a Pivotal Stapling Device; U.S. Ser. No. 089,337, Sheet Transport by Multiple Speeds in a Copier/Finisher; U.S. Ser. No. 089,338, now allowed, Sheet Set Separation Deivce; U.S. Ser. No. 089,339, now allowed, Bound Document Apparatus for a Copier; U.S. Ser. No. 089,341, now allowed, Bound Document Apparatus Latching Mechanism; U.S. Ser. No. 089,342, Reproduction Machine with Finishing Station; U.S. Ser. No. 089,333, now U.S. Pat. No. 4,281,920, A Stapler Arrangement for a Copier/Finisher; U.S. Ser. No. 089,428, Unlimited Catch Tray; U.S. Ser. No. 089,429, now allowed, Cascade Illumination and Switch; and U.S. Ser. No. 089,433, Message Que Interactive Control Console.

It is well known in the prior art to provide reproduction machines having two sided copy capability. For example, U.S. Pat. No. 3,645,615, shows the use of a main tray for feeding copy sheets to receive first side images and a buffer storage for temporarily retaining and feeding the first side copy sheets to receive the second side image for delivery to an exit hopper. U.S. Pat. No. 4,050,805 discloses an automatic duplex reproduction machine using an auxiliary tray pivotable with respect to an output hopper to selectively receive copy sheets with first side images from the output hopper for conveying back to a main copy paper feeder. A relatively high degree of automatic control in a duplex operation, often requires additional sheet feeding and paper path components or more sophisticated control.

Other prior art systems are less automatic. For example, copy sheets having a first side image of a document are manually transferred from an exit hopper back to a sheet supply for receiving the second side image of a document.

Systems such as U.S. Pat. No. 4,067,649 show the use of a semi-automatic document feeder, a paper supply, an interim storage unit and an output hopper for producing sets of duplex copies.

This type of duplex copying, although often minimizing additional machine elements, requires additional manual intervention with the need for a higher level of operator training to insure proper operation and to minimize incorrect operation. Other systems such as disclosed in U.S. Pat. No. 4,130,354, assigned to the same assignee as the present invention, combine a degree of operator intervention with an automatic document handler to provide duplex copies.

The degree of operator intervention is often the need to separate a set of documents to be copied into even and odd stacks, the need to properly arrange documents in descending or ascending order, the need to place the documents face up or face down if an automatic document handler is available, or the need to place the first pass copies in the proper numerical order and face up or face down in the appropriate paper feeder tray for the second pass.

It would therefore be desirable to provide a duplex capability in a reproduction machine that does not unnecessarily add to the complexity and cost of the control and the copy sheet handling apparatus and yet greatly simplifies the complexity and difficulty of operator intervention. It would be also desirable to provide a duplex copy reproduction machine in which all the documents are in an easily predictable sequence, the operator is not required to count or separate, the later merge the documents, blank sheets are automatically scheduled by the control system when required and at job completion the originals are in the correct order.

Accordingly, it is an object of the present invention to provide a new and improved reproduction machine capable of two sided copy operation that simplifies operator intervention and minimizes the complexity of the system. Further objects and advantages of the present invention will become apparent as the following description proceeds, and the features of novelty characterizing the invention will be pointed out with particularity in the claims annexed to and forming a part of this specification.

Briefly, the present invention is concerned with a reproduction machine using an auxiliary copy sheet feeding apparatus rather than a dedicated duplex tray interim storage unit to provide duplex copies. In particular, in simplex to duplex copying, the operator is only required to reverse order the documents for the first pass, place all the originals in the recirculating document handler, move half copies or one sided copies to an auxiliary feed tray, and finally reverse the order of the originals. In another feature, the blank sheets that are automatically scheduled are not billed on a customer billing meter.

For a better understanding of the present invention, reference numerals have been applied to like parts wherein.

Figure 1:
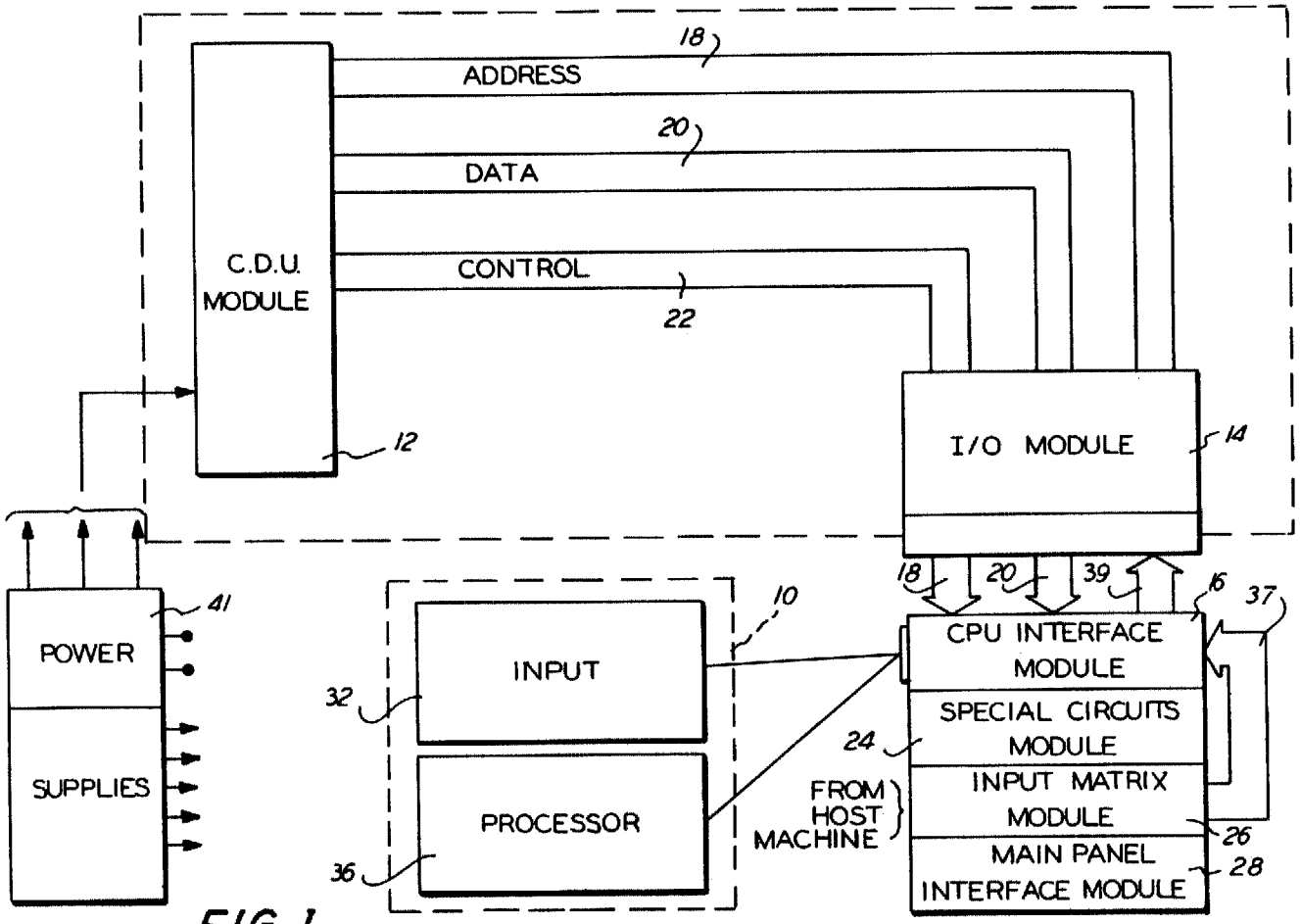
FIG. 1 is a block diagram of the controller incorporating the present invention.

Referring to FIG. 1, there is shown a reproduction machine 10 and a controller including a central processor unit (CPU) module 12, input/output (I/O) module 14 and CPU interface module 16. Address, data and control buses 18, 20 and 22 couple CPU module 12 and I/O module 14.

CPU interface module 16 connects the I/O module 14 with special circuits module 24, input matrix module 26 and main panel interface module 28. The CPU interface module 16 also interconnects I/O module 14 to the operating sections of the reproduction machine 10 namely, input section 32, and processor section 36.

Switch and sensor inputs are provided to the CPU module 12 from the machine from either the input matrix module 26 or the main panel interface module 28 via data buses 37 and 39. A power supply 41 is also interconnected to CPU module 12 as well as to other control elements.

For a more detailed description of the control, reference is made to U.S. Pat. No. 4,062,061, incorporated herein.

Figure 2:
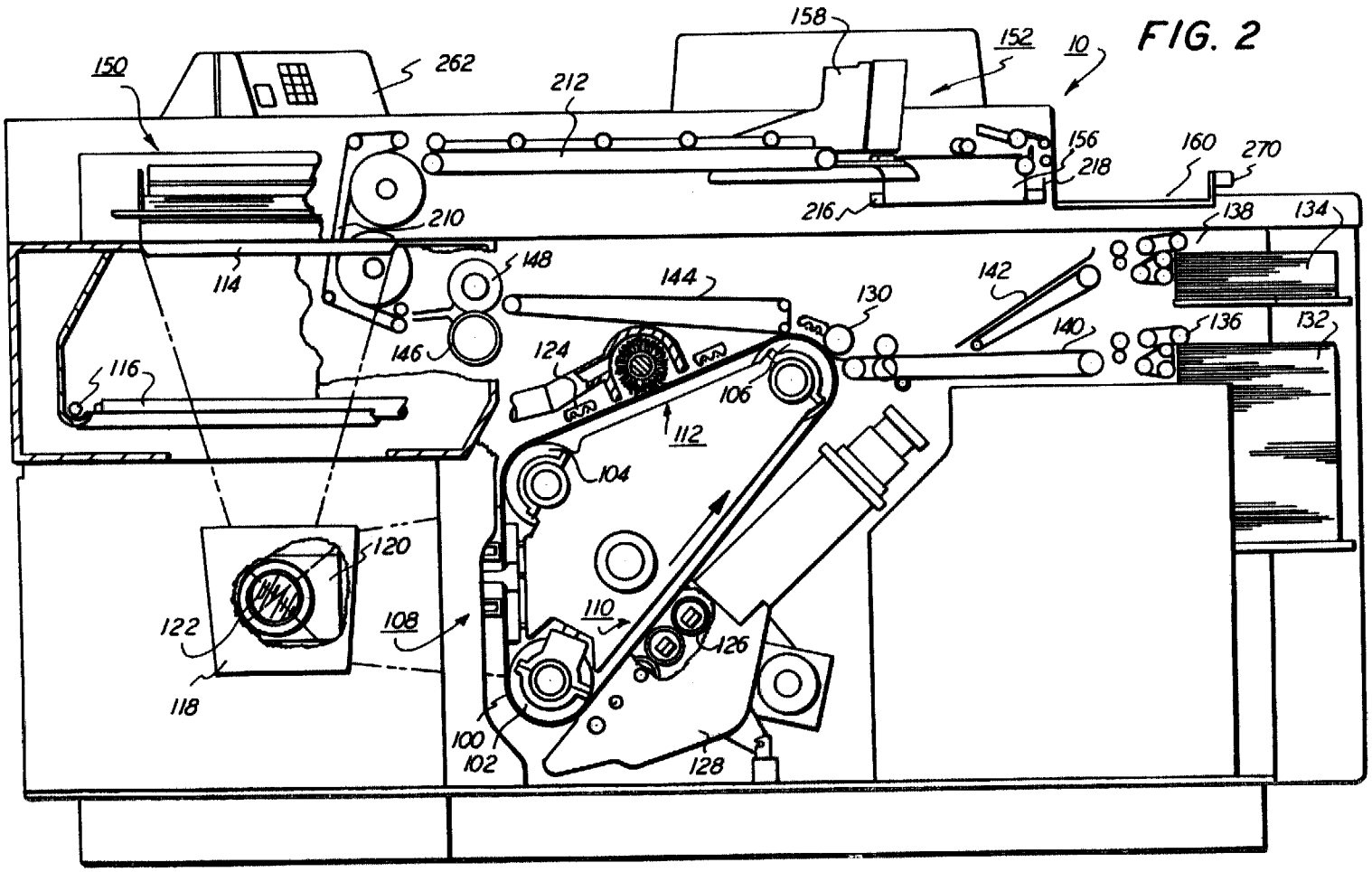
FIG. 2 is a cutaway elevational view of an exemplary reproduction apparatus incorporating the control system of FIG. 1.

Referring particularly to FIG. 2 of the drawings, there is shown, in schematic outline, an electrostatic reproduction machine or host machine, identified by numeral 10, incorporating the control arrangement of FIG. 1.

The machine 10 uses a photoreceptor in the form of an endless photoconductive belt 100 supported in generally triangular configuration by rolls 102, 104 and 106 and comprising a photoconductive layer of selenium, on a conductive substrate. Belt 100 is supported to provide substantially flat areas at exposure, developing, and cleaning stations 108, 110, 112 respectfully. The photoconductive belt 100 moves in the direction indicated by the solid line arrow, drive being provided through roll 106, in turn driven by a not shown main drive motor.

Machine 10 includes a generally rectangular, horizontal transparent platen 114 on which each original or document to be copied is disposed. A two or four sided, illumination assembly 116, disposed below and along at least two sides of platen, is provided for illuminating the original on platen 114. The light image generated by the illumination system is projected via mirrors 118, 120 and a variable magnification lens assembly 122 onto the photoreceptor belt 100 at the exposure station 108. To prepare belt 100 for imaging, belt 100 is uniformly charged to a preselected level by charge corotron 124. Magnetic brush rolls 126 are provided in a developer housing 128 at developing station 110. The bottom of housing 128 forms a sump within which a supply of developing material is contained.

To transfer developed images from belt 100 to the copy sheets, a transfer roll 130 engages copy sheets driven from either main or auxiliary tray 132, 134 by main and auxiliary sheet feeders 120, 121, respectively. Paper is generally fed from the main tray 132. Main transport 140 extends from main paper tray 132 to transfer roll 130 and is driven from the main motor. Auxiliary transport 142 extends from auxiliary tray 134 to main transport 140 and is also driven from the main motor. The image bearing sheets leaving the nip formed by photoconductive belt 100 and transfer 130 are picked off by vacuum transport 144 and conveyed to the fuser having a lower heated fuser roll 146 and upper pressure roll 148.

The reproduction machine 10 also includes a recirculating document handler (RDH) shown generally at 150 and a finishing station shown generally at 152. The recirculating document handler 150 shown in detail in FIG. 3 feeds originals automatically into platen 114 from tray 154. The machine 10 can make multiple collated sets of originals by successively feeding and removing originals from the platen 114. A manual input station is also provided to place an original under platen 114.

The finisher 152 contains a compiler tray 156, a stapler 158 and an offsetting catch tray 160. In the non-collation or stacks mode, successive, identical copy sheets are fed directly through the finisher 152 to the offsetting catch-tray 160. In the collation (RDH) or sets mode, successive, non-identical copy sheets are fed into the compiler tray 156 and compiled until the completion of the set. At this time the set is stapled or not stapled as required, and ejected to the offsetting catch-tray 160. The offsetting catch-tray 160 offsets between successive sets to maintain set integrity. A list of possible combinations between document input, copy, and output format is shown in Table I.

TABLE I

LIST OF AVAILABLE MODE COMBINATIONS

| Document Input | Copy | Offset Outputs |
|---|---|---|
| Manual Platen | 1/Sided Copy/Main Fd | Stacks |
| Manual Platen | 1/Sided Copy/Aux Fd | Stacks |
| Auto Feed/1 Sided Doc | 1/Sided Copy/Main Fd | Sets |
| Auto Feed/1 Sided Doc | 1/Sided Copy/Main Fd | Stapled Sets |
| Auto Feed/1 Sided Doc | 1/Sided Copy/Aux Fd | Sets |
| Auto Feed/1 Sided Doc | 1/Sided Copy/Aux Fd | Stapled Sets |
| Auto Feed/1 Sided Doc | 2/Sided Copy/Main Fd | Sets |
| Auto Feed/1 Sided Doc | 2/Sided Copy/Main Fd | Stapled Sets |
| Auto Feed/1 Sided Doc | 2/Sided Copy/Aux Fd | Sets |
| Auto Feed/1 Sided Doc | 2/Sided Copy/Aux Fd | Stapled Sets |
| Auto Feed/2 Sided Doc | 2/Sided Copy/Main Fd | Sets |
| Auto Feed/2 Sided Doc | 2/Sided Copy/Main Fd | Stapled Sets |
| Auto Feed/2 Sided Doc | 2/Sided Copy/Aux Fd | Sets |
| Auto Feed/2 Sided Doc | 2/Sided Copy/Aux Fd | Stapled Sets |
| Auto Feed/1 Sided Doc | 1/Sided Copy/Main Fd | Stacks |
| Auto Feed/1 Sided Doc | 1/Sided Copy/Aux Fd | Stacks |

Figure 3:
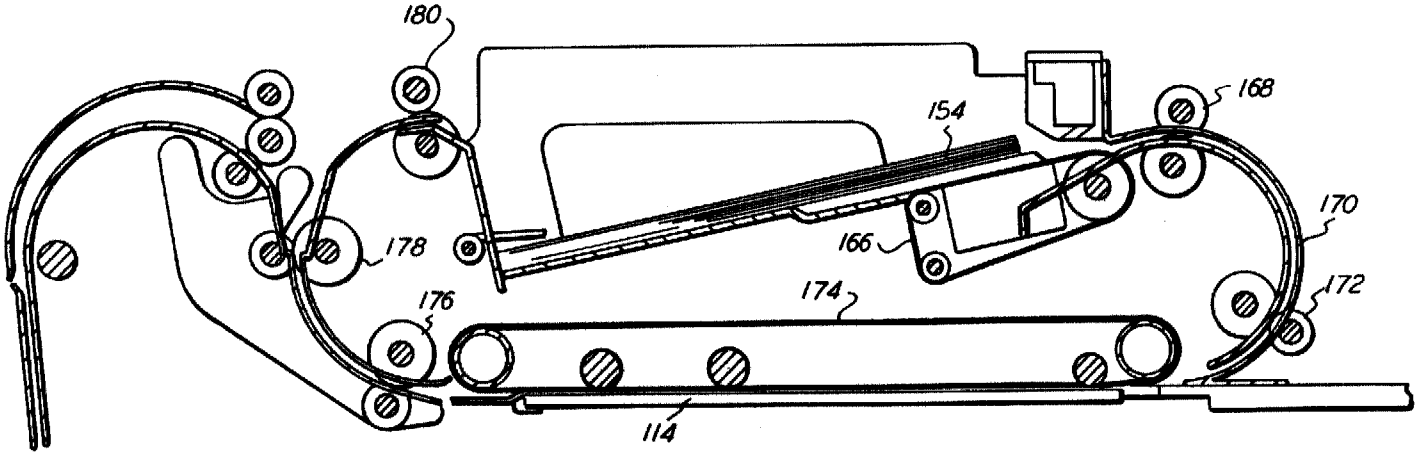
FIG. 3 is an elevational view of the recirculating document handler of the reproduction apparatus shown in FIG. 2.
Figure 4:
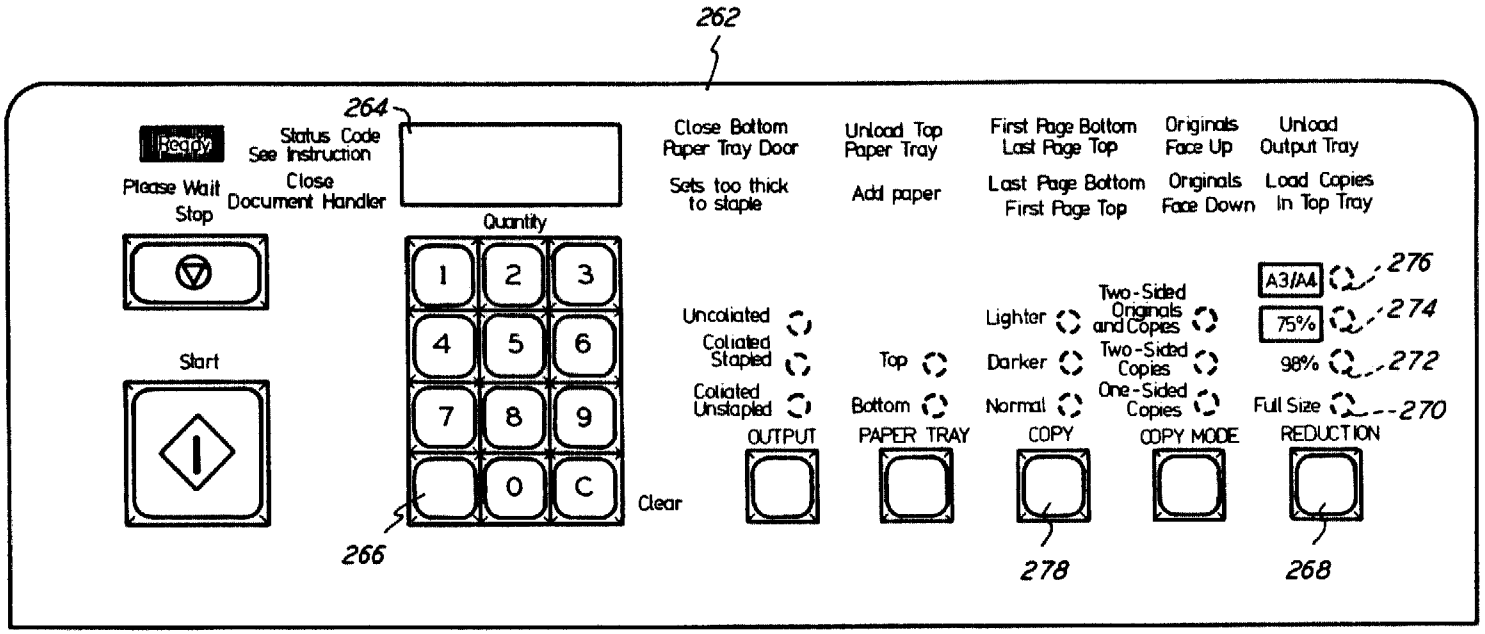
FIG. 4 is a detailed illustration of the operator control console shown in FIG. 2.
Figure 5:
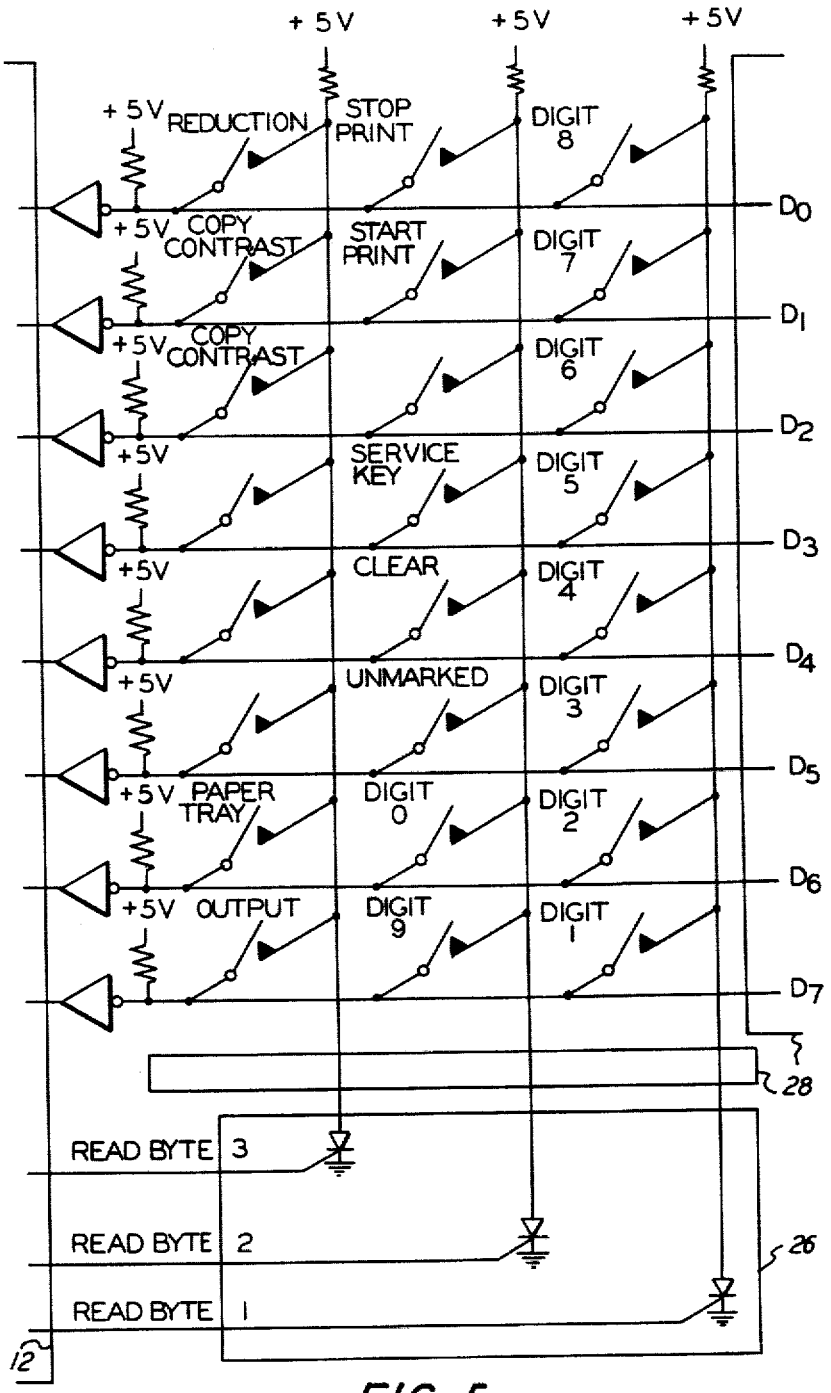
FIG. 5 is a schematic illustration of the interconnection of the push button switches shown in FIG. 4 with the controller of FIG. 1.

With reference to FIGS. 3 and 4 for the RDH 150 mode and one sided documents and copies, the operator programs the machine and places the originals in the RDH tray 154 face up (1 to N).

Documents are driven one at a time in N to 1 sequence from the botom of the set in tray 154 by feeder belt 166 to tray takeaway rollers 168. The platen entry rollers 172 drive the document into engagement with platen belt 174 for movement onto platen 114 into synchronism with the movement of the preceding document off platen 114.

After exposure, documents are driven off platen 114 by platen belt 174 into engagement with return transport rollers 176. The documents are conveyed to middle rollers 178 to tray entry rollers 180 for return to tray 154. The reproduction machine develops and delivers each copy in sequence face up to the catch tray 160. Complete sets of N copies each are offset in tray 160 and if the staple mode is selected the sets are stapled.

For one sided orignals/two sided copies, in the first pass, the operator places the document in the RDH tray 154 face up in reverse order and presses Print. The RDH advances each original in sequence and the even originals are flashed in (2 − N) sequence. If the set has an odd number of pages, the machine processor passes a blank sheet at the end of each set. There is no precount of documents by the RDH and there is one flash per two document feeds. The machine processor feeds a copy every other pitch or copy cycle. Skipped pitches are faded out with a pitch fadeout lamp. The copies are delivered to output tray 160 face up in descending order. That is

| |
|---|
| 8 (or blank if odd number of originals) |
| 6 |
| 4 |
| 2 |

The blank sheet is not billed and the tray 160 does not offset the set. Stapling, if selected, is inhibited during this pass. In the second pass, the operator removes the documents and reorders them into the original order, loads the RDH tray 154, moves the half-copies to the auxiliary feed tray 134 and presses Print. The RDH 150 operation is the same as first pass except odd documents are flashed (N−1). Again there is one flash per two feeds. The one side or half-copies are then conveyed from feed tray 134 via transport 142 to transfer roll 130 to receive a second side image. The machine processor operation is the same as the first pass except copies in the output tray 160 are in the correct order and the sets are offset. If selected, stapling of the sets is accomplished at this time. That is, the copy sheets for one complete set are accumulated in compiler tray 156, stapled and then ejected to the catch tray 160.

For the RDH 150 mode and two sided originals/two sided copies, in the first pass, the operator places the documents face down into RDH tray and presses Print. The RDH advances each document in 1−N sequence and flashes the back side of each document once per copy. There is one flash per feed. The machine processor develops and delivers each copy in sequence to the output tray 160 with one pitch skipped between sets. There is no offset of copies nor stapling. In the second pass, the operator flips the stack of documents over in the RDH tray 154, moves the half-copies from the output tray 160 to the auxiliary feed tray 134, and presses Print. The RDH operates the same as first pass except front sides are flashed in (N−1) sequence (one flash-/feed). The machine processor operation is the same as first pass except copies are in correct order and the sets are offset in the output tray, and if selected, the sets are stapled.

For the RDH mode of operation and stacked or uncollated copies, the operator places the documents face up in the RDH, programs the machine and presses Print. The machine makes the total quantity of copies programmed of the bottom document, delivers them to output tray 160 (does not compile) and shifts the tray after the last copy of each document is delivered. The RDH 150 indexes to the next document and resumes copying. The job output is offset stacks.

For manual operation, the operator places the document or book on platen 114 and presses Print. The machine makes the required copies, stacks them directly in the output tray 160 (not copiled), stops, shifts the tray and displays Ready.

Figure 6:
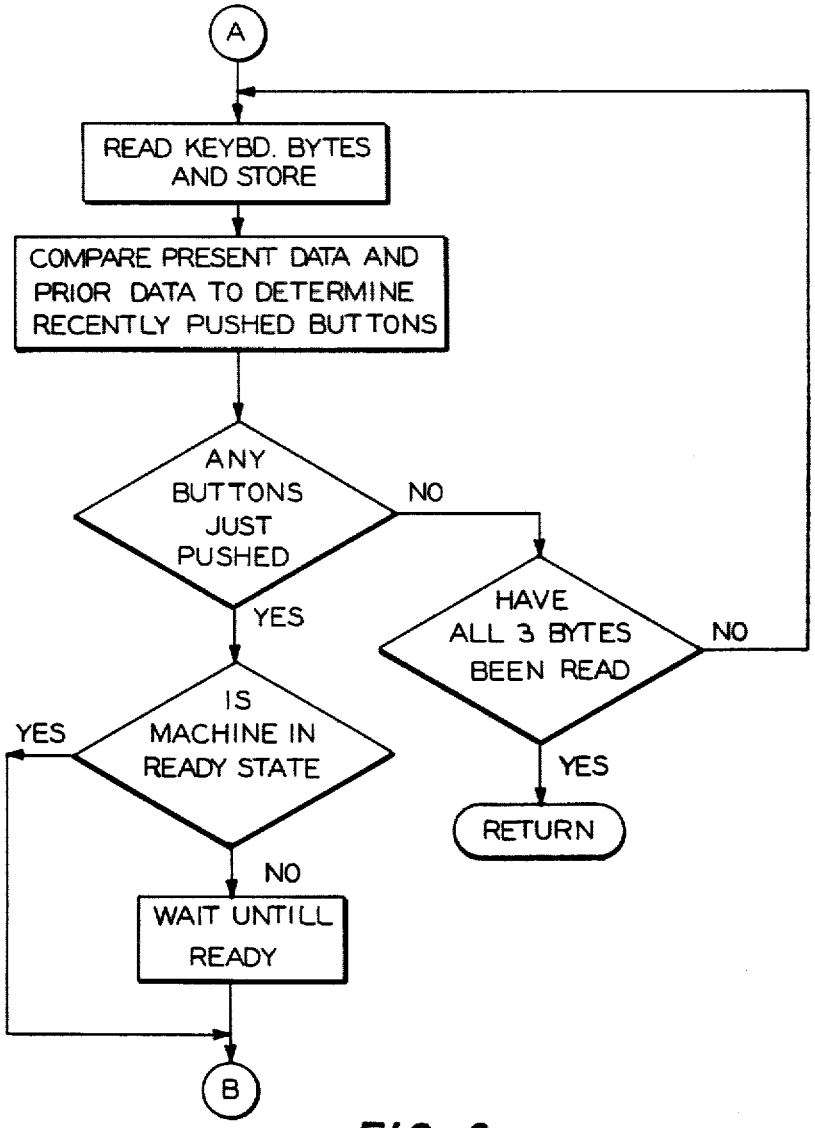
FIGS. 6 and 7 are a flow chart of the switch scan procedure of the controller disclosed in FIG. 1.
Figure 7:
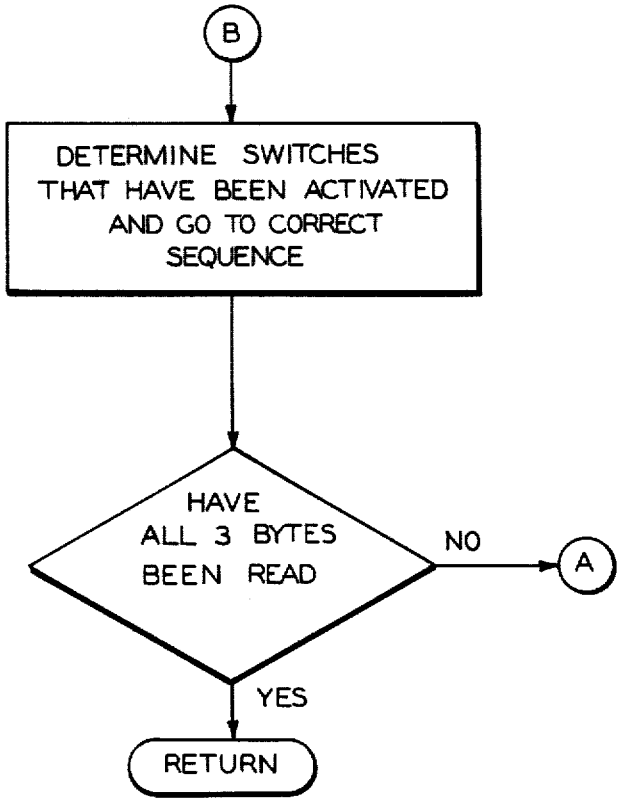

With reference to FIGS. 4 and 6, there is shown the operator's control console 262 including various inputs switches and indicator lamps. The interconnection of these switches and the main panel interface module 28, the input matrix module 26 and the CPU module 12 are illustrated in FIG. 7. Of course all connections to the CPU module are through the input/output module 14.

The console switches are continuously monitored by a switch scan procedure to initiate the correct operation for a particular combination of switch inputs. The inputs from the twenty console switches are arranged into three bytes of information as set forth below in Table II.

TABLE II

| | BIT POSITIONS | | | | | | | |
|---|---|---|---|---|---|---|---|---|
| | D7 | D6 | D5 | D4 | D3 | D2 | D1 | D0 |
| Keybd Byte 1 | Bit 1 | Bit 2 | Bit 3 | Bit 4 | Bit 5 | Bit 6 | Bit 7 | Bit 8 |
| Keybd Byte 2 | Bit 9 | Bit 0 | Bit Un-Marked | Bit Clear | Bit Serv. Key | Bit | Bit Start Print | Bit Stop Print |
| Keybd Byte 3 | Out-Put | Paper Tray | | | | Copy Con trast | Copy Mode | Reduc-tion |

Figure 8:
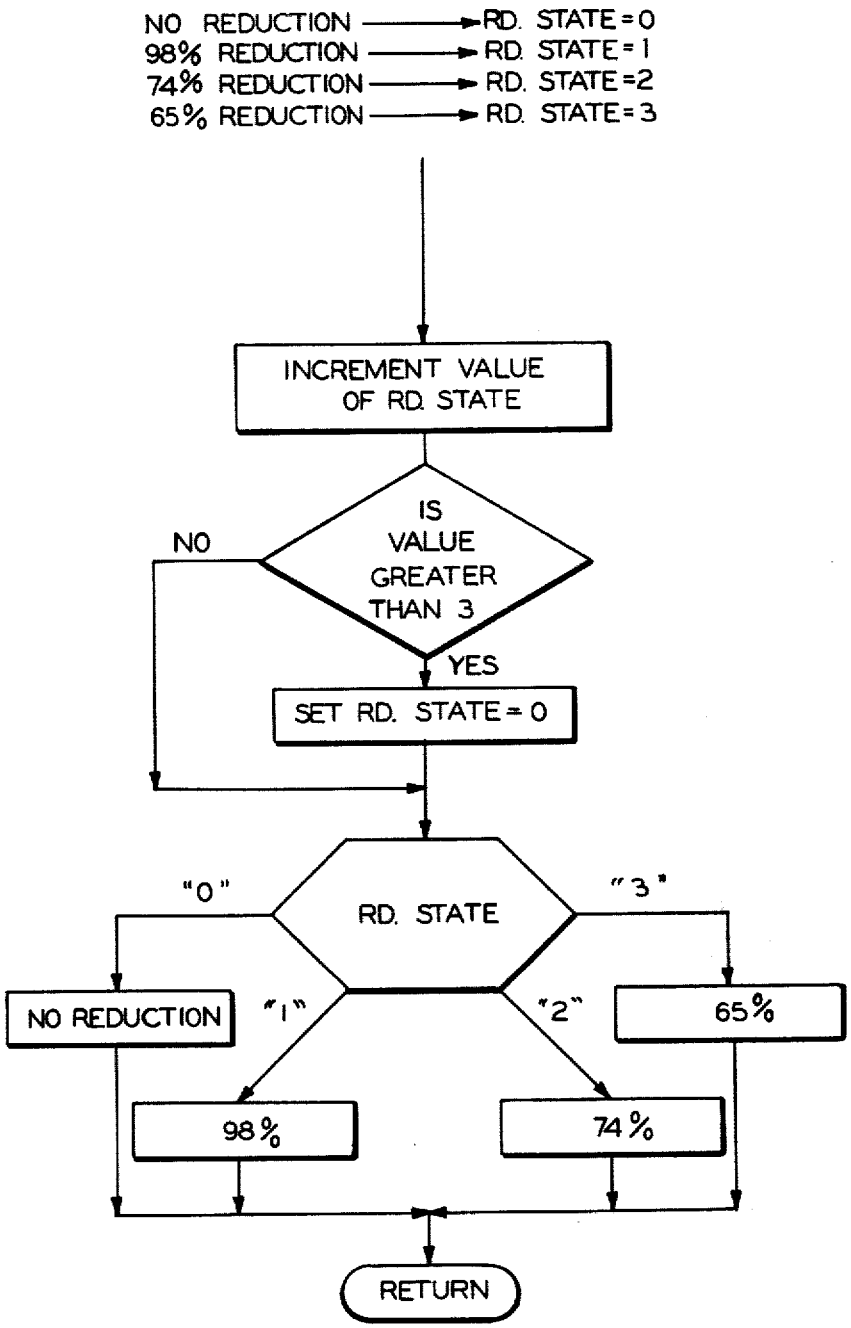
FIG. 8 is a flow chart of the multitask button cascade illumination feature of the present invention.
Figure 9:
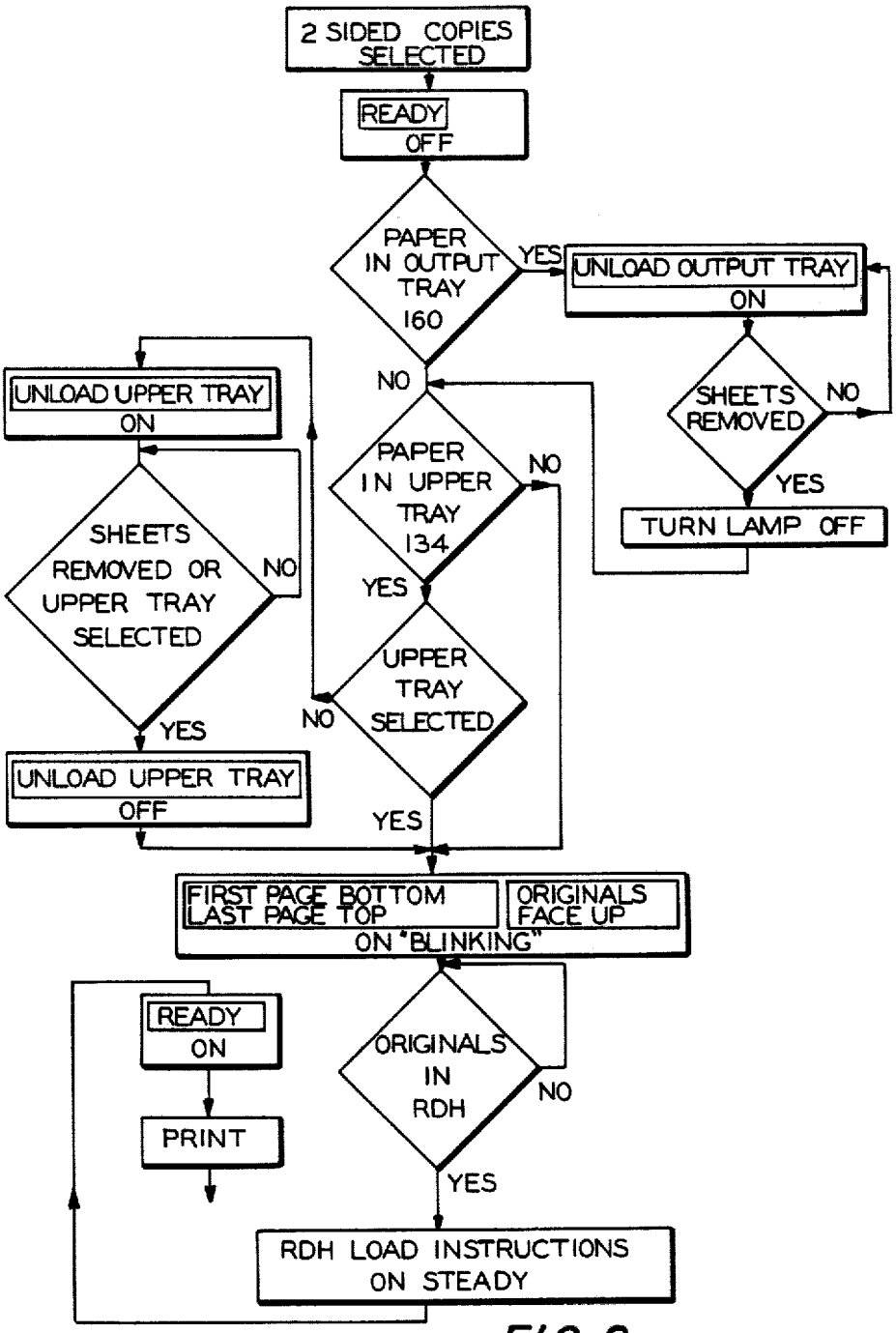
FIGS. 9 and 10 are flow charts of the message queing and duplex operation according to the present invention.

The switch scan procedure is shown in the flow charts of FIGS. 8 and 9. In particular, the scan is made every 20 milliseconds and in an effort to filter out noise, two readings of the byte are taken approximately 13 microseconds apart. If they are the same, a third reading is not required. If they are not the same, the result of a third reading taken approximately 13 microseconds later is used.

The machine is generally operating in one of eight different states namely an initialization, lamp test, run not print, print, ready, not ready, tech rep, and component control states. The system can be executing in only one state at a time. The system operates in a state until it recognizes a condition requiring a state change.

The initialization state is completed after a system self-test or system self diagnostics and in this state various flags and data are set to initial values required for system operation. In accordance with one feature of the present invention, the system enters the lamp test state and in this state turns on all front panel lights and indicates 8888 on the digital display 164 for an automatic lamp test feature. There is a short, approximately 5 seconds, display of all the front console lamps. This occurs shortly after power is turned on. This provides an indication to the operator of any burned out or otherwise inoperative display components. This also eliminates the need for a button to request the display. It should also be understood that as machine performance is monitored over a history of use, various changes are often required to the systems software to optimize operation. Generally these changes are made in various stages. Therefore for diagnostic and evaluation purposes it is often desirable to know the particular stage or level of software in the system. This information is available in the digit display 164 during this period of lamp tests by keying the unmarked push button 166 on the operator's console. A coded display will indicate the level of software in the system.

After the lamp test state, the system, at the expiration of the 5 seconds, enters the not ready state. There are approximately 11 conditions that must be satisfied before the system changes from the not ready to the ready state. For example, the lens selection must equal the lens position switch, that is, the lens must not be in motion, the bottom and top trays if selected must have enough paper, the fuser must be up to temperature, all stand by interlocks must be closed, the fuser must not be overtemperature, the photoreceptor belt must not be mistracked, all fault codes must be cleared, if RDH is selected it must not be in a jam condition, the offset catch tray 160 must not be full or the capacity cannot be exceeded, and the offset catch tray 160 must be emptied if two sided copy mode is selected.

The system next enters the ready state upon satisfying the not ready conditions and then is ready to enter the print state. From the ready state the system will normally go either to the print state back to the not ready state or to the tech rep state if required. Upon activation of the print button the system enters the print state. Upon completion of the reproduction run, or upon encountering a machine malfunction, the system exits from the print state to a run/not print state. After the completion of this state there is entered a not ready state.

The tech rep state is entered when the service key is on, the system is in not ready or ready state, and the display select and clear buttons are depressed simultaneously. This allows the tech rep to access programs not otherwise available, such as diagnostic programs.

In the various states, except the initialization state and the tech rep states, the machine or controller is generally performing housekeeping and systems operations. There are also provided a priority of interrupts to alert the controller of the reproduction machine events and requirements and to synchronize the controller and the reproduction machine. The events and requirements of the reproduction machine 10 generally require high speed response and to facilitate the response a multiple interrupts system is provided.

There are two external interrupts in particular a pitch reset interrupt and a machine clock interrupt. The pitch reset is the highest priority interrupt and is generated by a not shown reset switch synchronous with potential copy sheet registration in the reproduction machine. The interrupt initiates the resetting of various clocks and timed events for correctly operating on images and copy sheets in various stages in the process. The interrupt occurs only while the main motor is running and normally at a frequency of 1.25 Hz.

The second level of interrupt is the machine clock interrupt and is initiated by the machine clock pulses generated by a not shown magnetic pickup on the main drive motor. It performs the functions of scheduling and controlling events in synchronization during the print state and schedules and controls register output data to the reproduction machine components during all states of operation. A third interrupt, although a non-external interrupt, is a real time clock interrupt. This is the lowest priority interrupt used and the clock signals are produced by the controller clock to decrement several uniquely assigned memory cells at predetermined intervals. For a more detailed discussion of the overall operation of the controller, reference is again made to U.S. Pat. No. 4,062,061, incorporated herein.

In accordance with the present invention, the control console 262 is generally organized into signal push button cascaded displays. For example, the reproduction machine 10 in normal operation will produce full size copies unless the "reduction" button 268 is pressed. In other words, in system ready at start up, the lens 122 is in position for full size copying and the full size lamp 270 on console 262 is illuminated. However, upon actuation of the reduction button 268, the lens 122 will next position itself for 98% reduction with the corresponding lamp 272 illuminated. The next activation of the reduction button 268 will initiate the movement of the lens to the 74% reduction position with the corresponding lamp 274 illuminated, and similarly the system is moved to the 65% reduction and lamp 276 illuminated upon activation of button 268. The next activation of button 268 will return to a full size illumination.

Similarly, the operator may select normal, dark, or light output by successive actuation of the copy push button. As described, the successive pressing of push button 278 causes the controller to acknowledge by illuminating appropriate lamps and stepping from one selection to another in a wrap-around sequence. This stepping operation is allowable even while the system is making copies. However, the controller performs an immediate response and also set up a deferred action. In other words, the immediate task, that is the stepping of the Illuminated lamps occurs immediately to provide operator feedback. The deferred action, for example, is the movement of the lens or adjustment of the developer bias and adjustment of the lens iris opening for darker or lighter copies. The deferred action will be performed if there are no additional button actuations within a certain time period, for example, approximately 1 second. The delay is necessary to prevent needless dithering of the controller until the correct mode has been selected.

Figure 10:
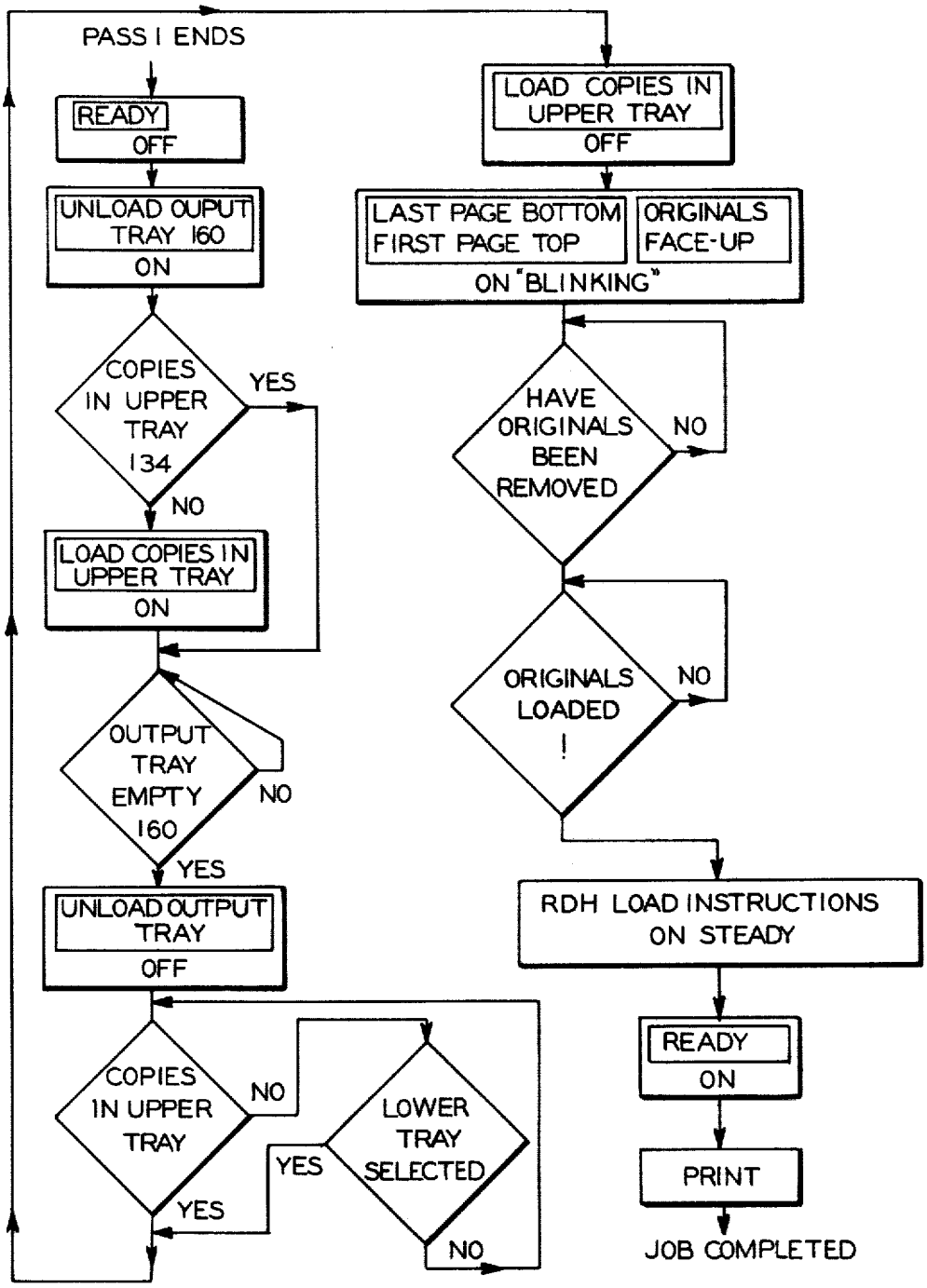

The multi-task button, cascade illumination feature is further described with respect to the reduction operation with reference to FIG 10. In particular, the reduction operation is determined by the count in a reduction state counter (Rd STATE). Counts of zero, one, two, and three correspond to no reduction, 98% reduction, 74% reduction and 65% reduction respectively. The counter is incremented in response to successive actuations of the reduction push button 268, with an initial state of zero or no reduction before any activation of the push button.

The sequence is merely to increment the counter in response to activations of the push button 268. In FIG. 10, the first decision block is to determine if the counter is greater than three, and if so to reset the counter to zero. The contents of the counter are then scanned and for a particular counter number a particular reduction mode is initiated. The switch scan is constantly monitoring the various switches in the machine and checking for changes caused by switch actuation.

As an example of reduction, assume that the counter is in the zero state and the reduction button is keyed twice for a 74% reduction. The activation of the button will be detected by the main panel interface module 28 and the input matrix module 26. The CPU module 12 will recognize the mode selected and set an appropriate flag, in this case, the 74% reduction flag and illuminate lamp 274. While this operation is being executed, the switch scan routine will continue to monitor the various switches for the possibility of a new mode selected or the 74% reduction having been cleared. If it is determined that the 74% reduction remains selected, the lamp 274 remains illuminated and it is determined that a new lens position is required. A determination is made of the current position of the lens and the lens drive motor is activated to drive the lens to the appropriate 74% reduction position. At the appropriate position, the wait light is turned off and the ready light turned on.

In accordance with the present invention, the control console 262 includes ten selectively illuminated lighted displays to assist the operator in operating the reproduction machine. In particular, the messages are Close Lower Paper Tray Door, Sets Too Thick To Staple, Unload Upper Paper Tray, Add Paper, First Page Bottom Last Page Top, Last Page Bottom First Page Top, Originals Face Up, Originals Face Down, Unload Output Tray, and Load Copies In Upper Tray. Most of these messages are primarily used to guide the operator through the process of making duplex copies in either a simplex to duplex or duplex to duplex mode. Some are used for other instructional purposes.

Although these messages are normally displayed in predetermined sequences or queues, the operator may perform operations appropriate to the duplex mode chosen in different or alternative order. In this case, queuing or sequence of the messages will adapt to the order of operator activity or performance. In any case, the queuing message is displayed or illuminated until the sensors detect that the appropriate action has been taken.

In other words, it is desirable to guide the operator with a limited number of messages at a time and to guide the operator in a step by step sequence. However, it is not necessary to follow the messages exactly. If the operator has already covered a particular step, it is skipped in the sequence of messages. The steps can be covered in any order as long as all necessary steps are completed for the next operation.

The operator is guided by appropriate backlit instructions as illustrated with reference to the flow chart shown in FIGS. 9 and 10. In particular, assume that the operator requires a single side document two sided copies mode. The operator will press the "Copy" button once to change from one sided copies to two sided copies.

The procedure referred to as "Pass 1," shown in FIG. 9 initially checks whether or not the output or catch tray 160 and the upper tray or auxiliary feed tray 134 are empty. If there is paper in the output or catch tray 160, the operator is instructed by the illuminated message "Unload Output Tray" on the control panel 262 to unload the output tray 160. Once the copies are unloaded the message lamp is turned off. The upper paper tray (auxiliary feed tray) 134 is also checked and if there is paper in the upper paper tray 134, the operator is instructed by the message "Unload Upper Paper Tray" to unload the upper paper tray (auxiliary feed tray) 134. Once the sheets have been removed from the upper paper tray 160, the message lamp is turned off as with the output tray message.

It should be noted that if the upper paper tray 134 has been selected for feeding paper, the "Unload Upper Paper Tray" message will not be illuminated and the operator will not be instructed to unload the upper paper tray. Another check is also made to determine if there are documents in the RDH.

Assuming the output and upper trays are empty, two more messages are illuminated in an on-off or blinking manner, in particular the "First Page Bottom, Last Page Top" message and the "Originals Face Up" message.

"The First Page Bottom, Last Page Top" and "Originals Face Up" messages (RDH load instructions) instruct the operator on how to place the documents to be copied in the RDH. The system will then monitor that there are documents in the RDH and it is assumed that the documents are in fact in the correct format. The RDH load instructions then remain on in a steady state. At this point the Ready lamp is illuminated if all conditions for ready are met and the operator activates Start Print. The machine then runs the first pass, that is copies the even numbered documents and delivers the copies to the output tray 160 for as many sets as required up to the tray capacity. At this point there is no offset of the sets nor any stapling. If the run length should cause the pass "1" copies to exceed the capacity of the output tray, the job is automatically broken up into tray-sized segments, each with a "Pass 1-Pass 2" sequence until the full job is completed or cancelled by the operator.

At the completion of the first pass, the system enters into the pass "2" sequence as illustrated in FIG. 10. In particular, the Ready lamp goes off and if the upper tray 134 has not been previously selected, it is automatically selected at this point by the controller. This is necessary because the side one copies will be loaded into and fed from the upper paper or auxiliary feed tray 134. At this time also all the duplex message lamps will be turned off. The "Unload Output Tray" message and the "Load Copies in Upper Tray" message will then be illuminated. Once the operator empties the output tray 160, the "Unload Output Tray" message will shut off and as soon as the operator loads the side one copies into the upper tray 134, the "Load Copies in Upper Tray" will be turned off.

The "Last Page Bottom, First Page Top" message and the "Original Face Up" message (RDH load instructions) will then be illuminated on the control console. This instructs the operator on how to reposition the documents in the RDH. Once the documents have been removed and replaced, it is assumed that the documents are in the correct order and the ready lamp is illuminated for another print cycle. If the documents have not been removed and replaced, the RDH load instruction messages that is the messages relating to RD operation, will flash in an on-off manner. Once removed and replaced, however, the RDH load instruction remain on in a steady condition and the machine completes the duplex operation.

The operation is similar for a duplex to duplex operation except instead of the "Original Face Up" message there is an "Original Face Down" message for pass 1. For pass 2, the "Original Face Up" message will be illuminated for RDH operation, operation instruction.

With respect to FIG. 2, there is shown the finisher area 152. In particular, there is a post fuser turnaround transport 210, a pre-registration transport 212, a compiler tray 156, a stapler 158, and the output or offsetting catch tray 160. Also included are compiler entrance and exit switches illustrated at 216 and 218, an offset catch tray out of paper and position sensor 270, and a not shown catch tray position motor.

The finisher module 152 receives fused copies from the turnaround transport 210 for reversing the direction of paper travel and delivering to the preregistration transport 212. The preregistration transport 212 ensures proper side registration for different size papers for proper staple location. Depending upon selection, stapled and collated sets can be provided by the stapler. A scuffer assembly (not shown) is located at the rear of the compiler tray 156 and is used for fine set registration and sheet ejection. The sheets scheduled for collating are captured in the tray 156 by two not shown plastic tabs called registration gate fingers. These gate fingers are down in the uncollated or stacks mode in order not to capture copies.

In accordance with the present invention, the offset catch tray sensor 270 monitors sheets left in the tray from a previous job. It will also signal Unload Tray if an operator selects duplex copying or, if the number of sheets or sets exceeds a maximum capacity, a machine cycle down will be initiated. The cycle down is approximately ten seconds longer than normal to enable the operator to unload the tray. If the job programmed was incomplete, unloading the tray will cause the Print cycle to resume.

The offsetting catch tray or output tray 160 is limited in capacity and can fill to the point of causing jams. The point of jam can vary depending upon whether there are stapled sets, non-stapled sets or stacks being produced. In accordance with the present invention, the sensor 270 is provided along with the "Unload Output Tray" message to prevent the occurrence of jams and yet allow the reproduction machine to complete high volume requirements. In particular, variable parameters are set in the non-volatile memory to be able to control the capacity of the output tray 160. In response to reaching a predetermined boundary for either stapled sets, ustapled sets or stacks, the system is shut down. However, if the tray is emptied during operation, the machine will restart and continue on with the operation.

In particular for limitless tray operation, the tray 160 capacity is controlled by an internal counter keeping track of both sets and copy sheets delivered. Reset of the counter occurs only when the tray is unloaded. In one embodiment a capacity of 40 sets and 350 sheets is set. The limits or tray boundaries held in non-volatile memory are service representative modifiable about a nominal capacity.

For the stapled sets mode, upon counting 40 stapled sets in the output tray, or the total sheet count exceeds 350, the machine lights "Unload Output Tray" and stops making copies for approximately 10 seconds, while the machine processor continues to run. When the tray is unloaded, the machine automatically restarts and resumes copying. For unstapled sets, operation is the same as above except only sheet count 350 (not set count) limits capacity; shutdown starts at the end of the set in process in this mode. In the uncollated mode, the capacity is also 350 sheets. For a series of shorter jobs, the counts of stapled sets and sheets are accumulated and reaching either of the limits starts a shutdown sequence. If the tray is not unloaded within 2 minutes, a 2 minute timeout occurs and the Print button must be pressed to resume operation.

What is claimed is:

1. In an electrophotographic copier having a display panel and having selective operating modes for making one sided or two sided copies, said two sided copy mode having a first side copy cycle during which a first side copy is formed on one side of a copy sheet and a second side copy cycle during which a second side copy is formed on the opposite side of the copy sheet, the method of operating in the two sided copy mode by instructing the operator in selective sequence by means of the display panel comprising the steps of:

manually reverse ordering the documents in a set of documents to be imaged, placing all the documents in an automatic document handler for producing first side copies in a receiving tray during a first side pass of copy sheets from a copy sheet supply, manually conveying the completed half copies from said receiving tray to a copy feed tray, and again manually reversing the order of the originals, and replacing all the documents in said automatic document handler to allow said first side copies to be automatically fed from the copy feed tray for receiving second side images.

2. The method of claim 1 including the step of instructing the operator to alter the contents of a selected tray.

3. The method of claim 2 including the step of inhibiting the display upon suitable operator action.

4. The method of claim 1 including the steps of altering the normal sequence of operator instructions in response to variable operator action.

5. In a reproduction machine for producing impressions of an original, the combination of a photosensitive member and a plurality of operating components cooperable with one another and the photosensitive member to produce the impressions on support material, a billing meter, a tray for feeding the support material, a second tray providing a buffer storage for duplex operation, a finisher area having a receiving tray, means to determine an odd number of documents to be copied, means to schedule a blank sheet and means to inhibit billing of the blank sheet.

* * * * *